US006574996B1

(12) United States Patent
Jacobus et al.

(10) Patent No.: US 6,574,996 B1
(45) Date of Patent: Jun. 10, 2003

(54) TUB SUMP DAM

(75) Inventors: Dwight William Jacobus, Louisville, KY (US); Robert Ray Cureton, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 08/866,907

(22) Filed: May 30, 1997

(51) Int. Cl.[7] ..... D06F 39/08; D06F 39/10
(52) U.S. Cl. ..... 68/18 D; 68/23.4; 68/208
(58) Field of Search ..... 68/208, 18 D, 68/23.4; 134/104.4; 210/305, 306, 307, 360.1

(56) References Cited

U.S. PATENT DOCUMENTS

| | | | | |
|---|---|---|---|---|
| 2,470,140 A | | 5/1949 | Castner | |
| 2,645,109 A | * | 7/1953 | Smith | 68/23.4 |
| 2,900,080 A | * | 8/1959 | Raczynski et al. | 68/208 X |
| 2,919,568 A | | 1/1960 | Stone et al. | |
| 3,216,224 A | | 11/1965 | Poole | |
| 3,246,837 A | * | 4/1966 | Douglas | 68/23.4 |
| 4,125,003 A | | 11/1978 | Wasemann | |
| 4,319,599 A | * | 3/1982 | Dingler et al. | 134/104.4 |
| 4,357,812 A | * | 11/1982 | Braga et al. | 68/18 D |
| 4,505,138 A | | 3/1985 | Lang | |
| 4,949,557 A | * | 8/1990 | Price | 68/23.4 |
| 5,127,417 A | * | 7/1992 | Tromblee et al. | 134/111 |

* cited by examiner

*Primary Examiner*—Philip R. Coe
(74) *Attorney, Agent, or Firm*—George L. Rideout, Jr., Esq.; Armstrong Teasdale LLP

(57) ABSTRACT

A washing machine including a tub having a helical flow path defined by a channel and a sump located at a lower end of the channel with a dam therein is described. In an exemplary embodiment, a water outlet is located in the sump, and the dam is positioned in the sump upstream from the outlet. The dam, in the exemplary embodiment, is substantially perpendicular to flow path and extends from a tub sidewall to at least beyond the outer perimeter of the water outlet. The dam has a sufficient height to prevent debris heavier than water from flowing from the channel to the outlet during a non-spin portion of a wash cycle, yet is low enough so that when the spin cycle is initiated, the debris will flow over the dam to the outlet.

20 Claims, 3 Drawing Sheets

TUB SUMP DAM

FIELD OF THE INVENTION

This invention relates generally to washing machines and, more particularly, to a dam for use in tub sumps for preventing debris from flowing into the drain pump inlet prior to start-up of the pump motor.

BACKGROUND OF THE INVENTION

Clothes washing machines typically include a clothes basket located within a tub. A water or tub outlet is located in a bottom portion of the tub, and a drain pump typically is located below the tub in flow communication with the outlet. In one known embodiment, the tub includes a helical flow path and a sump is located at the lower end of the path. The water outlet is an opening in the tub at the location of the sump and a conduit, sometimes referred to as a drain hose, extends from the outlet to the inlet of the pump.

In operation, water in the tub drains down along the helical flow path and into the sump. At selected times during a wash cycle, e.g., just prior to and during a spin cycle, the drain pump is energized and the pump draws water through the tub outlet and into the pump. Draining the free water, i.e., water not absorbed in clothes located in the basket, from the tub prior to and during the spin cycle improves washing machine performance by decreasing the occurrences and severity of out of balance loads.

With the above described washing machine configuration, debris flows with the water and into the sump. For example, if a rubber-backed rug is in the basket, some rubber particles will flow with the water down to the sump. During an agitation cycle, and even though the pump is not energized, some debris may flow through the tub outlet and into the drain hose. Some of the debris may even flow through the drain hose and to the inlet of the idle pump. The debris may collect in the hose and at the pump outlet, and such debris may plug the hose and pump. Therefore, when the pump is energized, the water may not be drained from the tub. In order to resume normal operations, the drain hose and pump inlet must be cleared, which typically requires some disassembly of the machine.

To prevent debris from flowing into the drain hose and into the pump inlet prior to activation of the pump, it is known to position traps or strainers over the tub outlet. Such traps and strainers collect debris and prevent debris from flowing through the tub outlet. Although known traps and strainers are effective at collecting debris, at least some known traps and strainers are complex to fabricate and assemble, which increases the cost of the washing machine. In addition, such traps and strainers may become plugged and inhibit the free flow of water from the tub through the outlet. Of course, limiting the free flow of water from the tub could lead to increasing the occurrence and severity of out of balance loads.

It would be desirable to prevent debris from plugging the drain hose and pump without substantially inhibiting the free flow of water through the tub outlet. It also would be desirable to provide such results using a simple structure which does not significantly increase the cost or complexity of the washing machine.

SUMMARY OF THE INVENTION

These and other objects may be attained by a washing machine including a tub having a helical flow path defined by a channel and a sump located at a lower end of the channel. A water outlet is located in the sump, and a dam is positioned in the sump upstream from the outlet. The dam, in an exemplary embodiment, is substantially perpendicular to flow path and extends from a tub sidewall to at least beyond the outer perimeter of the water outlet. The dam has a sufficient height to prevent debris heavier than water from flowing from the channel to the outlet during a non-spin portion of a wash cycle, yet is low enough so that when the spin cycle is initiated, the debris will flow over the dam to the outlet.

More particularly, and prior to operation, clothes are located in the washing machine basket and then washing machine operations are initiated by an operator. Prior to the spin cycle, the tub fills with water. Some of the water is absorbed in the clothes and some of the water is free water, i.e., not absorbed in the clothes. The free water flows down the helical path to the sump. To the extent that there is any debris in the water heavier than the water, such debris is at least partially blocked from the outlet by the dam.

Just prior to the spin cycle, the water pump is activated and water in the sump is drawn through the outlet to the pump. When the spin cycle starts, the pump continues to operate and due to the forces created during the spin cycle, debris previously blocked by the dam will flow over the top of the dam and down through the outlet to the pump. At this time, the pump has completely started-up and such debris flows into the pump without causing any plugging of the outlet and the pump.

As explained above, the sump and dam configuration prevents debris from plugging the drain hose and pump without substantially inhibiting the free flow of water through the tub outlet. Such configuration also is simple to fabricate and does not significantly increase the cost or complexity of the washing machine.

DETAILED DESCRIPTION

Figure 1:
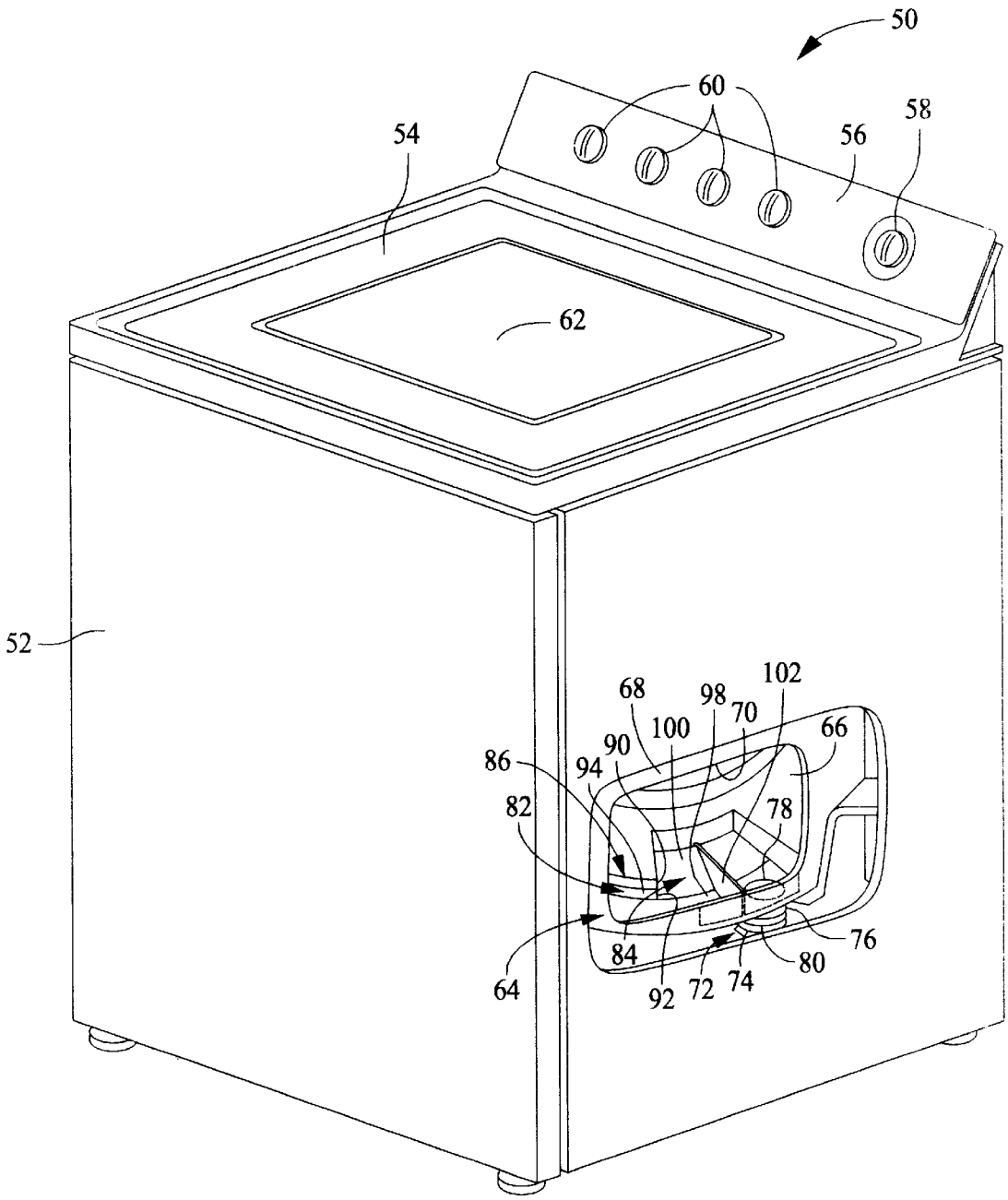
FIG. 1 is a perspective view of a washing machine with parts cut away.

FIG. 1 is a perspective view of a washing machine 50 with parts cut-away. Washing machine 50 includes a cabinet 52 and a cover 54. A backsplash 56 extends from cover 54, and a timer 58 and various washing machine controls 60 are secured to backsplash 56. A lid 62 is rotatably mounted to cover 54.

Washing machine 50 also includes a tub 64 having a bottom wall 66 and a sidewall 68, and a basket 70 positioned therein. As is well known, basket 70 rotates relative to tub 64 during some washing machine modes of operation, e.g., during the spin cycle. Washing machine 50 also includes a water pump 72 including a pump motor 74. A conduit, or drain hose, 76 extends from a tub water outlet 78 to a pump inlet 80. Washing machines such as washing machine 50 are well known, and such washing machines are commercially available from General Electric Company, Appliance Park, Louisville, Ky. 40225. These known washing machines could be modified to include a tub having a sump and dam as described below in more detail.

With respect to tub 64, a helical flow path 82 and a sump 84 are molded integral with tub 64. Helical path 82 is defined by a channel 86 in bottom wall 66 of tub 64. Channel 86 includes sidewalls 90 and 92 and a bottom wall 94 which extends between sidewalls 90 and 92. From a top view, channel 86 spirals downward in a helix towards sump 84. Sump 84 is located at the lower end of channel 86, and sump 84 is formed by tub sidewall 68, a bottom wall 98, and an angled inner wall 100. Sump bottom wall 98 and inner wall 100 also spiral downward in a helix toward outlet 78.

Sump 84 also includes a dam 102 which in the exemplary embodiment shown in FIG. 1 extends across bottom wall 98 and inner wall 100. More particularly, and referring to FIG. 2 which is a top view of a portion of washing machine 50 with parts cut away, dam 102 extends across helical path 82. In addition, and in the exemplary embodiment, dam 102 is substantially perpendicular to path 82 and is located upstream of outlet 78. Tub sidewall 68 and dam 102 form a catch area generally indicated at 104 which, as described below, facilitates preventing debris from flowing to outlet 78 prior to initiation of a spin cycle.

Figure 2:
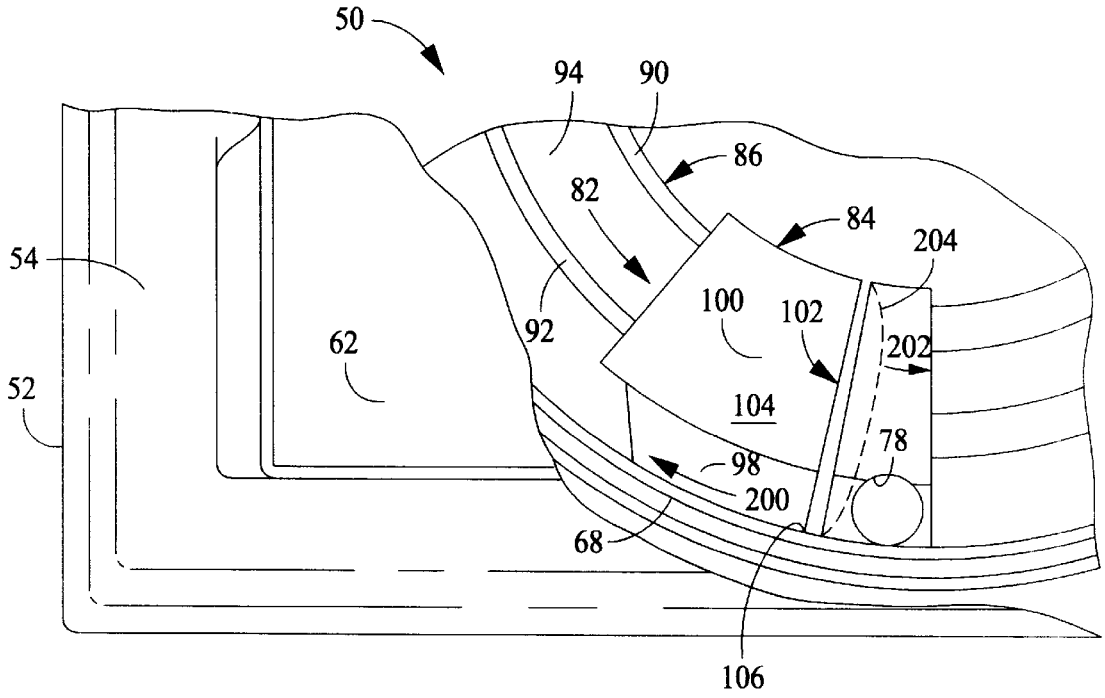
FIG. 2 is a top view of a portion of the washing machine shown in FIG. 1 with parts cut away.

Dam 102 need not extend completely across path 82 nor must dam 102 5 be perpendicular to flow path 82. For example, dam 102 could extend only partially, or not all, across inner wall 100, and dam 102 could extend only partially across bottom wall 98. Preferably, dam 102 extends from tub sidewall 68 to at least beyond the outer perimeter of outlet 78. Further, dam 102 could extend upstream 200 or downstream 202 relative to a location 106 at which dam 100 extends from tub sidewall 68. In addition, and in the exemplary embodiment, dam 102 is illustrated as having substantially planar side surfaces. Rather than planar side surfaces, such surfaces could be curved 204 as shown in FIG. 2.

Figure 3:
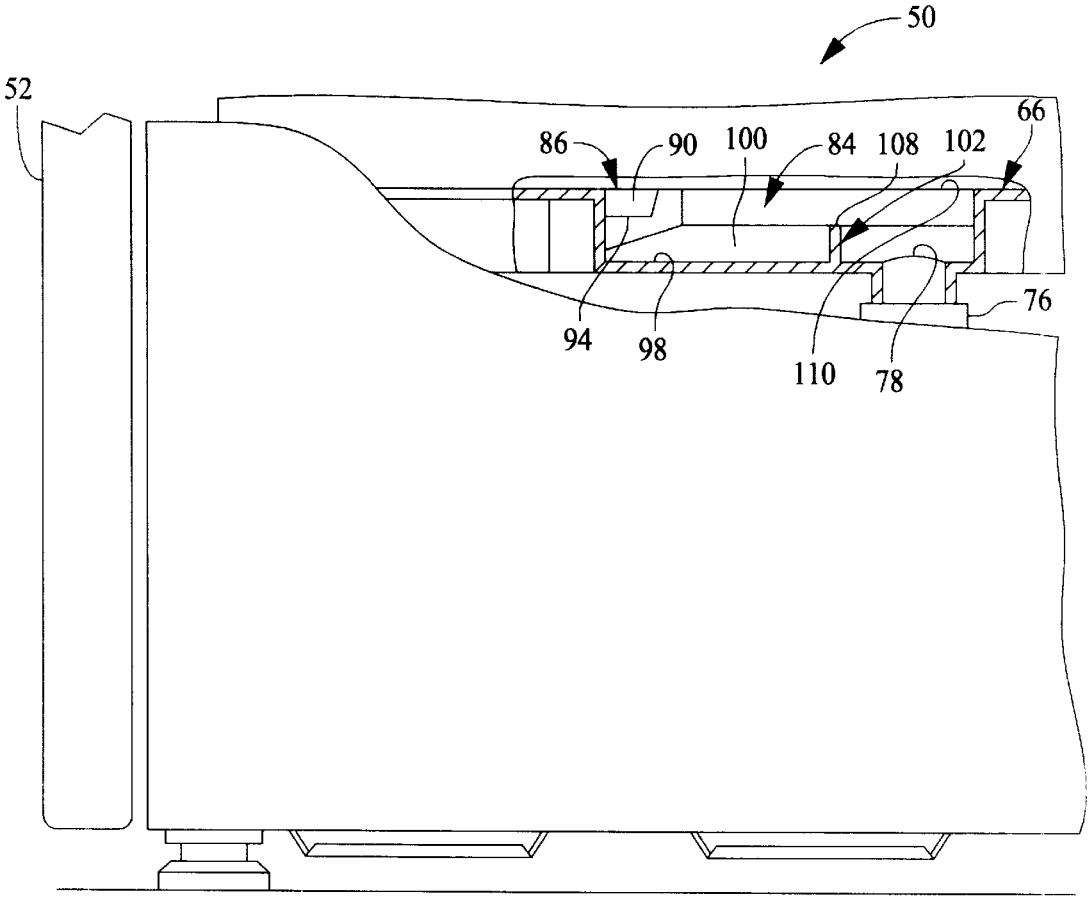
FIG. 3 is a side view of a portion of the washing machine shown in FIG. 1 with parts cut away.

FIG. 3 is a side view of a portion of washing machine 50 with parts cut away. As shown in FIG. 3, an upper surface 108 of dam 102 is below a surface 110 of tub bottom wall 66. Upper surface 108 generally is selected to have sufficient height to prevent debris heavier than water from flowing from channel 86 to outlet 78 during the non-spin portion of the cycle, yet low enough so that when the spin cycle is initiated, such debris will flow over dam 102 to outlet 78. The specific elevation of upper surface 108 may, however, be selected to have other elevations relative to surface 110 of tub bottom wall 66. For example, upper surface 108 may be at an elevation of approximately about ¾" to 1" above bottom wall 98. Further, upper surface 110 can be substantially planar as illustrated in the exemplary embodiment, or upper surface 110 could be curved.

Tub 64 typically is molded of a plastic, and dam 102 can be molded integral with tub 64. Alternatively, dam 102 can be molded separate from tub 64 and then secured thereto using, for example, a plastic heat joining process.

With washing machine 50, and prior to operation, clothes are located in basket 70 and then washing machine operations are initiated by an operator using controls 60 and timer 58. Prior to the spin cycle, tub 64 is filled with water. Some of the water is absorbed in the clothes and some of the water is free water, i.e., not absorbed in the clothes. The free water flows down helical path 82 to sump 84. To the extent that there is any debris in the water heavier than the water, such debris will be prevented from reaching outlet 78 by dam 102.

Just prior to the spin cycle, pump 72 is activated and water in sump 84 is drawn through outlet 78 to pump 72. When the spin cycle starts, pump 72 continues to operate and due to the forces created during the spin cycle, debris previously blocked by dam will flow over the top of dam 102 and down through outlet 78 to pump 72. At this time, however, pump 72 has completely started-up and such debris flows into pump 72 without causing any plugging of outlet 78 and pump 72.

The above described sump and dam configuration prevents debris from plugging the drain hose and pump without substantially inhibiting the free flow of water through the tub outlet. Such configuration also is simple to fabricate and does not significantly increase the cost or complexity of the washing machine.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A dam for a sump of a washing machine tub, the tub including a channel defining a water flow path and the sump located at a lower end of the channel, a water outlet located in the sump, said dam located in the sump and upstream from the water outlet, said dam extending from a sidewall of the tub to at least partially block debris flowing from the channel to the water outlet.

2. A dam in accordance with claim 1 wherein said dam extends substantially perpendicular to the flow path.

3. A dam in accordance with claim 1 wherein said dam and the tub sidewall define a catch area for catching debris.

4. A dam in accordance with claim 1 wherein said dam extends from the tub sidewall to at least beyond the outer perimeter of the water outlet.

5. A dam in accordance with claim 1 wherein said dam extends upstream relative to a location at which said dam extends from the tub sidewall.

6. A dam in accordance with claim 1 wherein said dam extends downstream relative to a location at which said dam extends from the tub sidewall.

7. A dam in accordance with claim 1 wherein sidewalls of said dam are substantially planar.

8. A dam in accordance with claim 1 wherein sidewalls of said dam are curved.

9. A dam in accordance with claim 1 wherein said dam is integral with the tub.

10. A dam in accordance with claim 1 wherein an upper surface of said dam is below a bottom surface of a tub bottom wall.

11. A dam in accordance with claim 10 wherein said upper surface is substantially planar.

12. A dam in accordance with claim 10 wherein said upper surface is curved.

13. A dam in accordance with claim 1 wherein said dam upper surface has a sufficient elevation to at least partially block debris heavier than water from flowing from the channel to the outlet during a non-spin portion of a wash cycle, and when a spin cycle is initiated, allows the debris to flow to the outlet.

14. A washing machine comprising a tub comprising a water outlet, and a pump in flow communication with said water outlet, said tub further comprising a sump and a channel defining a flow path, said sump located at a lower end of said channel and said water outlet located in said sump, a dam located in said sump and upstream from said water outlet, said dam extending from a sidewall of said tub to at least partially block debris flowing from said channel to said water outlet.

15. A washing machine in accordance with claim 14 wherein said dam extends substantially perpendicular to said flow path, and said dam and said tub sidewall define a catch area for catching debris.

16. A washing machine in accordance with claim 14 wherein said dam extends from said tub sidewall to at least beyond an outer perimeter of said water outlet.

17. A washing machine in accordance with claim 14 wherein said dam extends upstream relative to a location at which said dam extends from said tub sidewall.

18. A washing machine in accordance with claim 14 wherein sidewalls of said dam are substantially planar.

19. A washing machine in accordance with claim 14 wherein sidewalls of said dam are curved.

20. A washing machine in accordance with claim 14 wherein an upper surface of said dam has a sufficient elevation to at least partially block debris heavier than water from flowing from said channel to said outlet during a non-spin portion of a wash cycle, and when a spin cycle is initiated, allows the debris to flow to said outlet.

* * * * *